US011217409B2

(12) United States Patent
Hofsaess

(10) Patent No.: US 11,217,409 B2
(45) Date of Patent: Jan. 4, 2022

(54) TEMPERATURE-DEPENDENT SWITCH

(71) Applicant: Marcel P. Hofsaess, Steintahleben (DE)

(72) Inventor: Marcel P. Hofsaess, Steintahleben (DE)

( * ) Notice: Subject to any disclaimer, the term of this patent is extended or adjusted under 35 U.S.C. 154(b) by 0 days.

(21) Appl. No.: 16/866,077

(22) Filed: May 4, 2020

(65) Prior Publication Data

US 2020/0357589 A1 Nov. 12, 2020

(30) Foreign Application Priority Data

May 9, 2019 (DE) ..... 10 2019 112 074.8

(51) Int. Cl.

| | |
|---|---|
| ***H01H 37/52*** | (2006.01) |
| ***H01H 37/60*** | (2006.01) |
| ***H01H 37/04*** | (2006.01) |
| ***H01H 37/64*** | (2006.01) |

(52) U.S. Cl.

CPC ..... *H01H 37/52* (2013.01); *H01H 37/04* (2013.01); *H01H 37/60* (2013.01); *H01H 37/64* (2013.01)

(58) Field of Classification Search

CPC ..... H01H 37/5409; H01H 37/5427; H01H 37/70; H01H 37/52; H01H 37/74; H01H 2037/549; H01H 37/04; H01H 37/60; H01H 37/64

USPC ..... 337/89, 367

See application file for complete search history.

(56) References Cited

U.S. PATENT DOCUMENTS

| | | | | |
|---|---|---|---|---|
| 2,622,169 A | | 12/1952 | Cataldo et al. | |
| 3,925,742 A | * | 12/1975 | Muench | H01H 50/326 335/186 |
| 4,053,859 A | | 10/1977 | Hollweck | |
| 4,117,443 A | * | 9/1978 | Hofsass | H01H 37/5409 337/348 |

(Continued)

FOREIGN PATENT DOCUMENTS

| | | | |
|---|---|---|---|
| DE | 892468 B | 10/1953 | |
| DE | 2544201 A | 4/1977 | |

(Continued)

OTHER PUBLICATIONS

Search Report issued by European Patent Office for application 20170813.8 dated Sep. 16, 2020.

*Primary Examiner* — Anatoly Vortman
(74) *Attorney, Agent, or Firm* — Reising Ethington, P.C.

(57) ABSTRACT

A temperature-dependent switch which comprises a first and a second stationary counter contact and a temperature-dependent switching mechanism having a current transfer member. The switching mechanism, depending on its temperature, either closes the switch by pressing the current transfer member against the first and the second counter contact and thereby establishing an electrically conductive connection between the two counter contacts via the current transfer member, or opens the switch by keeping the current transfer member at a distance from the first and the second counter contact and thereby interrupting the electrically conductive connection. A closing lock is provided, which keeps the switch open when it has been opened for the first time. The closing lock comprises a spring washer which directly interacts with the current transfer member and mechanically locks the latter permanently when the switch has been opened for the first time so that the switch remains permanently open.

15 Claims, 8 Drawing Sheets

(56) References Cited

U.S. PATENT DOCUMENTS 4,470,033 A * 9/1984 Hofsass ..... H01H 37/5427 337/343
4,554,525 A * 11/1985 Bayer ..... H01H 37/5409 337/348
4,885,560 A * 12/1989 Niino ..... H01H 37/002 337/3
4,908,596 A 3/1990 Wells et al.
5,877,671 A 3/1999 Hofsaess
5,986,535 A * 11/1999 Stiekel ..... H01H 37/5427 337/298
6,191,680 B1 * 2/2001 Hofsass ..... H01H 37/002 337/333
6,249,211 B1 * 6/2001 Hofsaess ..... H01H 1/504 337/333
6,590,489 B1 * 7/2003 Ullermann ..... H01H 73/303 337/56
6,741,159 B1 * 5/2004 Kuczynski ..... H01H 37/002 337/142
7,071,809 B2 * 7/2006 Davis ..... H01H 37/5409 337/343
7,209,336 B2 * 4/2007 Yu ..... H01C 7/126 200/400
7,345,568 B2 * 3/2008 Yu ..... H01H 37/002 337/13
8,847,725 B2 * 9/2014 Buettner ..... H01H 37/54 337/365
9,691,576 B2 * 6/2017 Mitschele ..... H01H 1/504
2014/0225709 A1 8/2014 Kirch et al.
2019/0221390 A1 7/2019 Hofsaess

FOREIGN PATENT DOCUMENTS

DE 8625999 U1 11/1986
DE 19623570 A1 1/1998
DE 102007042188 B3 4/2009
DE 102011016142 A1 9/2012
DE 102012103279 B3 9/2013
DE 102013101392 A1 8/2014
DE 102018100890 B3 7/2019
EP 3511968 A1 7/2019

* cited by examiner

TEMPERATURE-DEPENDENT SWITCH

CROSS REFERENCE TO RELATED APPLICATIONS

This application claims priority from German patent application DE 10 2019 112 074.8, filed on May 9, 2019. The entire contents of this priority application are incorporated herein by reference.

BACKGROUND OF THE INVENTION

This disclosure relates to a temperature-dependent switch.

An exemplary temperature-dependent switch is disclosed in DE 10 2013 101 392 A1.

The disclosed switch comprises a temperature-dependent switching mechanism having a temperature-dependent bi-metal snap disc and a bistable spring disc, which carries a movable counter contact or a current transfer member in the shape of a contact plate. When the bi-metal snap disc is heated to a temperature above its response temperature, it lifts the counter contact or the current transfer member from the counter contact or counter contacts against the force of the spring disc and thereby presses the spring disc into its second stable configuration in which the switching mechanism is situated in its high-temperature position.

When the switch and consequently the bi-metal snap disc cool down again, said snap disc snaps back into its first configuration. However, due to the design, it is not able to brace with its edge on a counter bearing such that the spring disc remains in the configuration in which the switch is open.

The disclosed switch therefore remains in its open position after being opened once even when it cools down again. However, tests carried out by the company of the applicant have shown that the disclosed switch closes again in the event of stronger mechanical vibrations such that—under safety aspects—it may not be the perfect solution in some applications.

A switch disclosed in DE 10 2007 042 188 B3 comprises three switching positions. The switch is closed in its low-temperature position so that the two counter contacts are electrically connected to one another.

In its high-temperature position, the switch is open so that no current is able to flow through the switch. In its cooled-down position, the switch continues to stay open although the snap disc has cooled down again and consequently has re-assumed its low-temperature position.

In this way, the temperature-dependent switch is a one-time switch which after being opened once then also remains open when the temperature of the snap disc has decreased again.

Comparable one-time switches are disclosed in DE 86 25 999 U1 and DE 25 44 201 A.

Such temperature-dependent switches are used in a known manner for the purpose of protecting electrical devices from overheating. To this end, the switch is connected in series to the device to be protected and to the supply voltage thereof and is arranged mechanically on the device such that it is thermally connected to said device.

Below the response temperature of the snap disc, the two counter contacts are electrically connected to one another such that the electrical circuit is closed and the load current of the device to be protected flows through the switch. If the temperature rises above an admissible value, the snap disc lifts off the contact member from the counter contact against the actuating force of the spring disc, as a result of which the switch is opened and the load current of the device to be protected is interrupted.

The now current-less device can then cool down again. In this case, the switch, which is coupled thermally to the device, also cools down and would thereupon actually close again automatically.

In the case of the four switches mentioned above, it is now ensured that said switching back in the cooled-down position does not occur such that the device to be protected, once being shutoff, may not automatically switch on again. This is a safety function which is to avoid damage, as applies, for example, in the case of electric motors which are used as drive units.

It is also known to provide such temperature-dependent switches with a so-called self-holding resistor which is connected in parallel with the two counter contacts so that it takes over part of the load current when the switch opens. Ohmic heat, which is sufficient to hold the snap disc above its response temperature, is generated in said self-holding resistor.

Said self-holding, however, is only active for as long as the electric device is still switched on. As soon as the device is shut off from the supply circuit, no more current flows through the temperature-dependent switch so that the self-holding function is cancelled.

After the electric device has been switched on again, the switch would be situated in the closed state again so that the device is able to heat up again, which could result in consequential damage.

Said problems are avoided in the case of the temperature-dependent switches disclosed in DE 10 2007 042 188 B3 and DE 10 2013 101 392 A1, where the self-holding function is not realized electrically but by means of a bistable spring part which comprises two stable geometric configurations in a temperature-independent manner, as is described in the above-cited documents.

In contrast to this, the snap disc is a bistable snap disc which, in a temperature-dependent manner, assumes either a high-temperature configuration or a low-temperature configuration.

In the case of the switch disclosed in the above-mentioned DE 10 2007 042 188 B3, the spring disc is a circular spring snap disc on the middle of which the contact member is fastened. The contact member is, for example, a movable contact part which is pressed by the spring disc against the first stationary counter contact which is arranged on the inside of a cover of the housing of the disclosed switch.

The spring snap disc presses by way of its edge against an inner bottom of a lower part of the housing which acts as a second counter contact.

In this way, the spring disc, which is itself electrically conducting, produces an electrically conducting connection between the two counter contacts.

The external connection of the disclosed switch is established, on the one hand, via the outer surface of the electrically conducting lower part and, on the other hand, via through-plating of the first stationary counter contact through the upper part on the outer surface thereof, where, for example, a solder connection can be provided.

The bistable snap disc, in the case of the disclosed switches, is a bi-metal snap disc which switches from its convex into a concave configuration upon exceeding its response temperature.

Centrally, the bi-metal snap disc of the switch disclosed in DE 10 2007 042 188 B3 comprises a through-opening by way of which it is put over the movable contact part which is fastened on the spring disc.

In its low-temperature position, the bi-metal snap disc lies loosely on the contact part. If the temperature of the bi-metal snap disc increases, it snaps over into its high-temperature position in which it presses with its edge against the inside of the upper part of the housing and, concurrently, with its center onto the spring disc such that said spring disc snaps from its first into its second stable configuration, as a result of which the movable contact part is lifted off from the stationary counter contact and the switch is opened.

If the temperature of the switch cools down again, the bi-metal snap disc snaps into its low-temperature position again. In this case, it moves with its edge into abutment with the edge of the spring disc and with its center into abutment with the upper part of the housing. However, the actuating force of the bi-metal snap disc is not sufficient to let the spring disc snap back into its first configuration again.

The bi-metal snap disc only bends further once the switch has cooled down a lot such that it is finally able to press the edge of the spring disc onto the inner bottom of the lower part by such a distance that the spring disc snaps into its first configuration again and re-closes the switch.

The switch disclosed in DE 10 2007 042 188 B3 therefore, after being opened once, remains open until it has cooled down to a temperature below room temperature, for which purpose a cold spray, for example, may be used.

Although said switch meets the corresponding safety requirements in many applications, it has nevertheless been shown that as a result of bracing the bi-metal snap disc between the upper part of the housing and the edge of the spring disc, in rare cases the spring disc nevertheless springs back in an unwanted manner.

According to the above description, the disclosed switch conducts the load current of the device to be protected through the spring disc, which is only possible up to a certain current strength. Namely, in the case of higher current strengths, the spring disc is heated so much that said electrical self-heating results in the switching temperature of the bi-metal snap disc being achieved before the device to be protected has actually reached its inadmissible temperature.

In the case of the switch disclosed in DE 10 2013 101 392 A1, the spring disc is fixed with its edge to the lower part of the housing, while the bi-metal snap disc is provided between the spring disc and the inner bottom of the lower part.

Below the response temperature of the bi-metal snap disc, the spring disc presses the contact disc against the two counter contacts. If the bi-metal snap disc snaps into its high-temperature position, it thus presses with its edge against the spring snap disc and pulls the spring disc away from the upper part by means of its center so that the contact disc moves out of abutment with the two counter contacts. So that this is geometrically possible, contact disc, spring disc and bi-metal snap disc are connected together captively by a centrally extending rivet.

When the temperature of the bi-metal snap disc drops again, it snaps back into its low-temperature position, but the spring disc remains in its assumed configuration as the bi-metal snap disc lacks a counter bearing for its edge so that it is not able to press the current transfer member against the two stationary counter contacts again.

Said switch therefore comprises a self-holding function due to the design. In rare cases, in the event of strong mechanical vibrations, the spring snap disc can spring back in an unwanted manner here too.

A temperature-dependent switch with a current transfer member realized as a contact bridge, where the contact bridge is pressed against two stationary counter contacts via a closing spring, is disclosed in DE 25 44 201 A1 which has already been mentioned above.

The contact bridge is in contact via an actuating bolt with a temperature-dependent switching mechanism which consists of a bi-metal snap disc and a spring disc, both of which are clamped at their edges.

As with the switch disclosed in DE 10 2007 042 188 B3, the spring disc and the bi-metal snap disc are both bistable, the bi-metal snap disc in a temperature-dependent manner and the spring disc in a temperature-independent manner.

If the temperature of the bi-metal snap disc increases, it presses the spring disc into its second configuration in which it presses the actuating bolt against the contact bridge and thereby lifts said contact bridge from the stationary counter contacts against the force of the closing spring.

Even when the bi-metal snap disc cools down, the spring disc remains in said second configuration and holds the disclosed switch open against the force of the closing spring.

Pressure can then be exerted from outside by means of a button onto the contact bridge such that, as a result, the spring disc is pressed back into its first stable configuration by means of the actuating bolt.

Along with the very complex design, said switch, on the one hand, comprises the disadvantage that in the open state, the spring disc lifts the contact bridge from the counter contacts against the force of the closing spring so that the spring disc, in its second configuration, has to overcome the force of the closing spring in a reliable manner. Because the closing spring, however, in the closed state ensures the secure abutment of the contact bridge against the counter contacts, a spring disc with a very high degree of stability is necessary here in the second configuration.

A further switch with three switching positions is disclosed in DE 86 25 999 U1 which has already been mentioned. A flexible tongue, which is clamped-in at one end and carries a movable contact part at its free end, which contact part interacts with a fixed counter contact, is provided in the disclosed switch.

A calotte is realized on said flexible tongue, which calotte is pressed into its second configuration, in which it distances the movable contact from the stationary counter contact, by means of a bi-metal plate which is also fastened on the flexible tongue.

In the case of said switch, the calotte has to hold the movable contact part at a distance from the fixed counter contact against the closing force of the flexible tongue which is clamped-in at one end so that the calotte has to apply a high actuating force in its second configuration.

The switch consequently comprises the above-discussed disadvantages, that namely high actuating forces have to be overcome, which leads to high production costs and to a non-secure state in the cooled-down position.

In the German patent application DE 10 2018 100 890.2, a switch is disclosed which comprises in an embodiment a contact plate like the switch disclosed in the above mentioned DE 10 2013 101 392 A1, but which contact plate is permanently mechanically locked by the closing lock when the switch is opened for the first time. The closing lock includes a first latching element on the edge of the contact plate and a second latching element interacting with it, which is arranged on the inside of a spacer ring. Assembling this switch has proven to be problematic in some cases.

SUMMARY

It is an object to provide a temperature-dependent switch with a structurally simple design, wherein the switch shall ensure secure interruption of the power circuit even in the event of strong vibrations.

According to an aspect, a temperature-dependent switch is provided, which comprises a first stationary counter contact, a second stationary counter contact, and a temperature-dependent switching mechanism having a current transfer member, wherein the switching mechanism is configured to close and open the switch depending on its temperature, wherein the switching mechanism is configured to close the switch by pressing the current transfer member against the first counter contact and the second counter contact and thereby establishing an electrically conductive connection between the first counter contact and the second counter contact via the current transfer member, and to open the switch by keeping the current transfer member at a distance from the first counter contact and the second counter contact and thereby interrupting the electrically conductive connection, wherein the switch further comprises a closing lock which is configured to keep the switch open when it has been opened for the first time, wherein the closing lock comprises a spring washer which is configured to directly interact with the current transfer member and to mechanically lock the current transfer member in a permanent manner when the switch has been opened for the first time, so that the switch remains permanently open.

The closing lock mechanically and permanently locks the current transfer member. Thus, the switch cannot close again after opening once, even if strong vibrations or temperature fluctuations occur. Consequently, also the switch is locked mechanically by means of the mechanical locking device, which is used synonymously in the context of the present application.

The closing lock comprises a spring washer, which can be inserted without major problems and, if necessary, connected to the current transfer member during the assembly of the switch.

The temperature-dependent switching mechanism may comprise a temperature-dependent snap element, preferably a bi-metal snap disc, which causes the switching mechanism to open in the usual way by lifting the current transfer member from the stationary counter contact.

The temperature-dependent switching mechanism may also comprise a bistable spring disc which, in the closed state of the switch, provides the closing force and thus the contact pressure between the movable current transfer member and the counter contacts. This mechanically relieves the bi-metal snap disc, which has a positive effect on its service life and the long-term stability of the response temperature.

In a refinement, the temperature-dependent switching mechanism comprises a temperature-dependent snap disc having a geometrical high-temperature configuration and a geometrical low-temperature configuration, and a bistable spring disc at which the current transfer member is arranged, wherein the spring disc has two geometrical configurations which are stable in a temperature-independent manner and, in its first configuration, presses the current transfer member against the first and second counter contact and, in its second configuration, presses the current transfer member away from the first and second counter contact.

According to a further refinement, the snap disc, when transitioning from its low-temperature configuration to its high-temperature configuration, is supported by its edge at a part inside the switch and thereby acts on the spring disc such that the spring disc snaps from its first to its second stable configuration, wherein further preferably the snap disc and the spring disc are fixed to the current transfer member via their respective centers.

The advantage here is that largely common temperature-dependent switching mechanisms can be used for the novel switch so that the structural expenditure on starting serial production of the novel switch is low.

In a refinement, the snap disc is fixed to the current transfer member and a clearance is provided for the edge of the snap disc, into which clearance the edge projects at least in part when the snap disc re-assumes its low-temperature configuration with the spring disc being in its second configuration.

When the snap disc snaps back again into its low-temperature position, its edge then moves into the clearance in which no abutment is provided for it such that it is not able to push the spring disc back again into its first configuration.

Even strong mechanical vibrations do not result here in the spring disc springing back again into its first configuration in which it would re-close the switch, being prevented from doing so by the closing lock.

Without said clearance, the bi-metal snap disc would, when snapping back into its low-temperature configuration, exert a pressure onto the spring disc which would allow said spring disc to snap into its other stable geometric configuration again. However, said operation is then prevented by the closing lock.

If then in a further refinement, the clearance is provided for the edge of the bi-metal snap disc in addition to the mechanical locking by means of the closing lock, in the first instance there is no generation of closing pressure which the closing lock has to absorb. Thus, the switch remains permanently open.

If, however, strong mechanical vibrations result in the bi-metal snap disc snapping back into its low-temperature configuration, the mechanical locking nevertheless holds the switch open.

In said refinement, the closing lock only has to absorb the closing pressure in rare cases, which further increases the reliability of the herein presented switch.

In a further refinement, the switch includes a housing on which the two counter contacts are provided and in which the switching mechanism is arranged.

This ensures that the switching mechanism is protected from the ingress of contaminants. The housing can be an individual housing of the switch or a pocket on the device to be protected from overheating.

If the spring disc is fixed by way of its edge to the housing, fixing the spring disc by way of its edge to the housing ensures that the current transfer member remains securely positioned in relation to the counter contacts.

In a further refinement, the housing comprises a lower part closed by an upper part, wherein the two counter contacts are arranged on an inner side of the upper part.

This ensures that, when the upper part is being mounted on the lower part, the geometrically correct assignment between the counter contact or the counter contacts and the respective contact member is produced at the same time.

In a further refinement, the lower part comprises an inner bottom, above the edge region of which a clearance is provided for the edge of the snap disc.

This makes it possible to provide a switch which is temperature-dependent with the three switching positions when a bistable spring part with two configurations which are stable in a temperature-independent manner is used.

In a refinement, the spring washer interacts with the current transfer member and with a spacer ring which is arranged between the upper part and the lower part, wherein the spring washer is preferably arranged on one side between the spacer ring and the upper part and comprises at least one locking member, which interacts with the current transfer member.

The spacer rings may be arranged between the lower part and the upper part in temperature-dependent switches in order to reach the necessary installation height which enables a sufficiently large switching path between the counter contact and the contact member in order to ensure the necessary electrical insulation in the open switch.

Here the simple assembly is advantageous, because after the insertion of the spacer ring, which is necessary when assembling the switch anyway, the spring washer is placed next, which is then fixed by the upper part placed afterwards together with the spacer ring and the switching mechanism. In order not to change the switching path and the height of the switch, it may be necessary to shorten the spacer ring a bit.

In a refinement, the locking member comprises a radially inwardly resilient tongue, which rests pre-stressed against an edge of the current transfer member when the switch is closed, and which braces on the current transfer member when the switch is open.

It may be necessary to use an assembly aid, such as a spreading tool, to allow the or each tongue to thread between the radially outward facing edge of the current transfer member and the spacer ring during assembly of the switching mechanism in the low-temperature position.

The or each radially inwardly resilient tongue is thus located between the spacer ring and the current transfer member when the switch is closed. When the switch opens, the current transfer member moves downwards and the or each resilient tongue is released from its edge and moves radially inwards over the current transfer member, which is thus permanently mechanically locked by the or each tongue and prevented from moving upwards again into contact with the two counter contacts, even if the switching mechanism cools down and the spring disc snaps back into its first configuration.

In another refinement, the spring washer is arranged on the current transfer member and comprises at least one locking member, which interacts with the spacer ring, wherein the locking member preferably comprises a radially outwardly resilient tongue, which rests pre-stressed against an inner surface of the spacer ring when the switch is closed, and which braces on a recess in the spacer ring when the switch is open.

After inserting the switching mechanism in the lower part, the spacer ring is subsequently inserted here as well. Then the spring washer is placed on the current transfer member, wherein the outwardly resilient tongues are moved radially inwards by contact with the inner surface of the spacer ring.

It may be necessary to fix the spring washer on the current transfer member, which can be done by snapping on, soldering, gluing or other suitable measures.

Next, the upper part is put on and the switch is closed in the usual way.

The or each radially outwardly resilient tongue may rest against an inner surface of the spacer ring when the switch is closed. When the switch opens, the current transfer member moves downwards and the or each resilient tongue is released from the inner surface and moves radially outwards into the recess in the spacer ring, thereby mechanically locking the current transfer member permanently. The current transfer member which is connected to the spring washer is thus mechanically prevented by the or each resilient tongue from moving upwards again into contact with the two counter contacts, even if the switching mechanism cools down again and the spring disc is snapped back into its first configuration.

Further advantages emerge from the description and the accompanying drawing.

It is to be understood that the features mentioned above and the features yet to be explained below are usable not only in the combination provided in each case but also in other combinations or standing alone without departing from the spirit and scope of the present disclosure.

DESCRIPTION OF PREFERRED EMBODIMENTS

Figure 1:
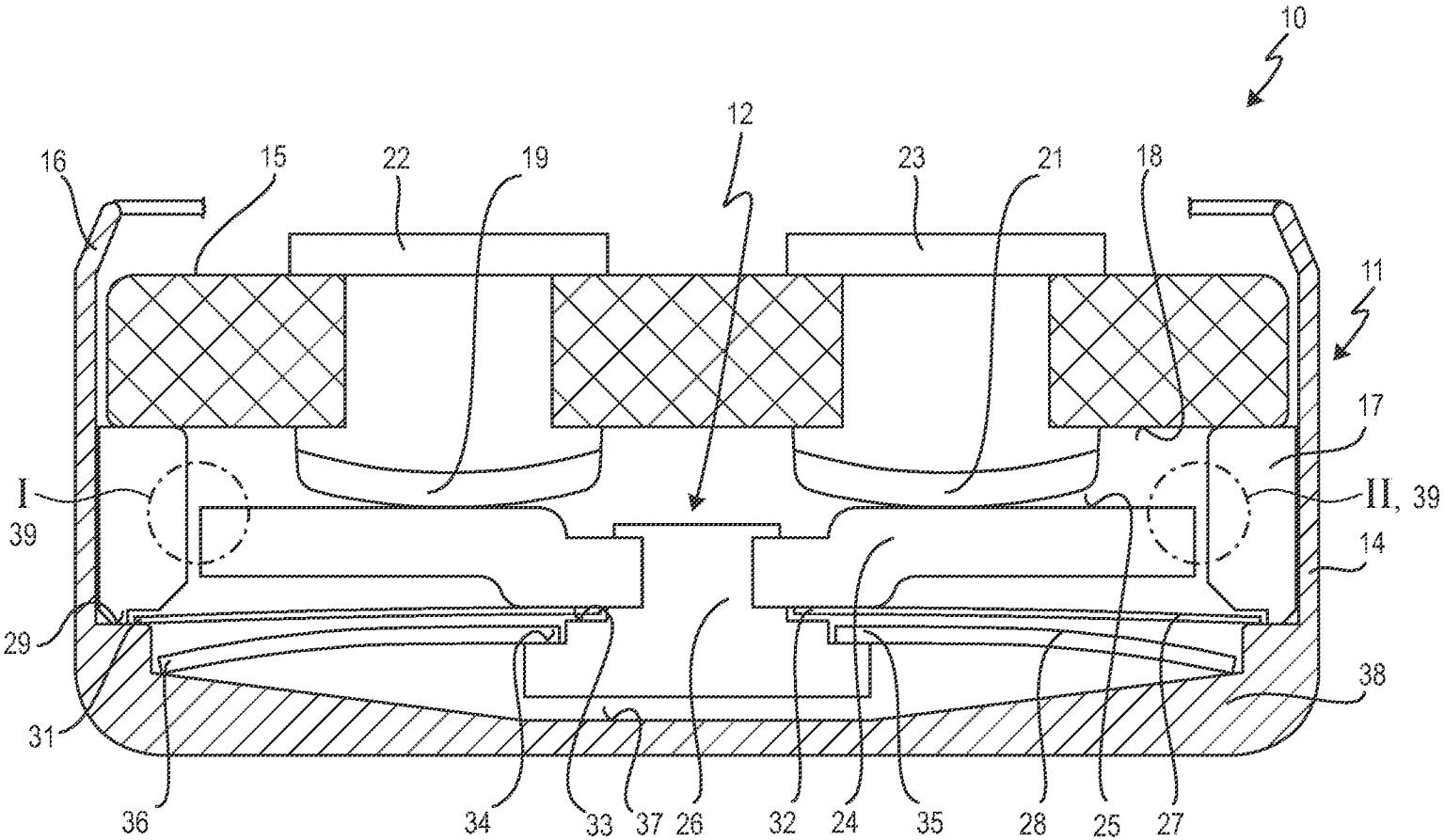
FIG. 1 shows a schematic side view of a switch in the closed state.

FIG. 1 shows a schematic, sectioned side view of a switch 10 which is realized in a rotationally symmetrical manner in top view and preferably comprises a circular form.

The switch 10 comprises a housing 11 in which a temperature-dependent switching mechanism 12 is provided.

The housing 11 includes a pot-like lower part 14 which is produced from electrically conducting material and a flat, insulating upper part 15 which is held on the lower part 14 by means of a bent-over edge 16. For reasons of clarity, the bent-over edge 16 is not shown solidly right across the upper part 15.

A spacer ring 17, which holds the upper part 15 at a spacing from the lower part 14, is provided between the upper part 15 and the lower part 14.

The upper part 15 comprises an inner surface 18 on which a first stationary counter contact 19 and a second stationary counter contact 21 are provided. The counter contacts 19 and 21 are realized as rivets which extend through the upper part 15 and end on the outside in heads 22 or 23 which serve for the external connection of the switch.

The switching mechanism 12 further includes a current transfer member 24 which, in the shown embodiment, is a contact disc, the upper side 25 of which is coated in an electrically conducting manner so that in the case of the system shown in FIG. 1 it ensures an electrically conducting connection between the two counter contacts 19 and 21 at the counter contacts 19 and 21.

As usual, the components consisting of solid material, here the spacer ring 17 and the contact disc 24, are not hatched, although they are also shown cut.

The current transfer member 24 is connected via a rivet 26, which is also to be seen as part of the contact member, to a bistable spring disc 27 and a bistable snap disc 28.

Figure 2:
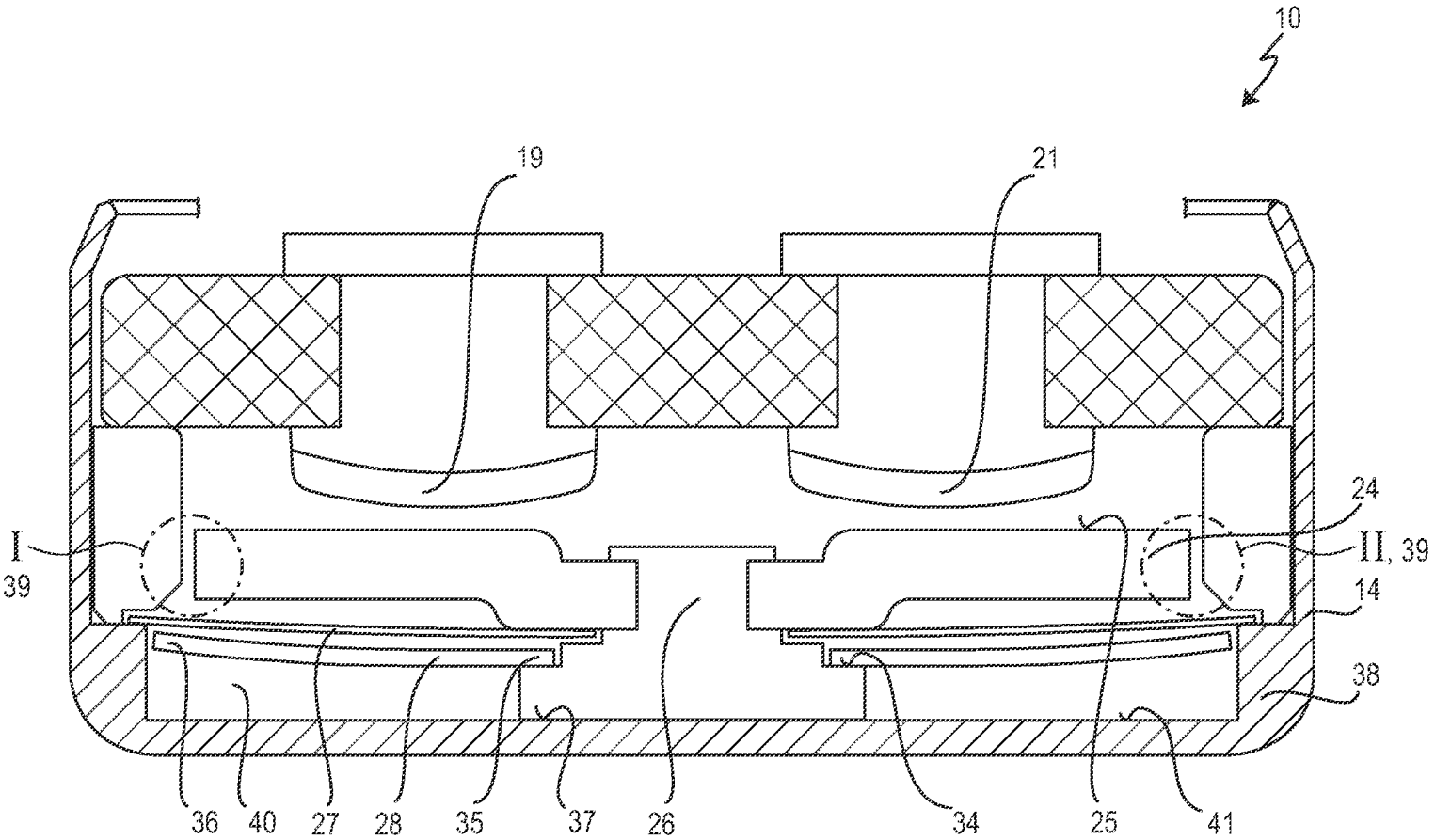
FIG. 2 shows a representation as FIG. 1, but in the closed state of the switch, wherein a clearance is provided here for the edge of the snap disc.

The spring disc 27 comprises two temperature-independent configurations, the first configuration of which is shown in FIG. 1 (closed switch 10) and the second configuration in FIG. 2 (open switch 10).

The snap disc 28 comprises two temperature-dependent configurations, namely its low-temperature configuration which is shown in FIG. 1 (closed switch 10) and its high-temperature configuration which is shown in FIG. 2 (open switch 10).

A circumferential shoulder 29, on which the spacer ring 17 rests, is provided in the inside of the lower part 14. The spring disc 27 is clamped by way of its edge 31 between the shoulder 29 and the spacer ring 17, whilst it rests by way of its center 32 on a shoulder 33 on the rivet 26. The spring disc 27 is consequently clamped at its center 32 between the current transfer member 24 and the shoulder 33.

Another shoulder 34, on which the snap disc 28 rests by way of its center 35, can be seen in FIG. 1 further below and further radially outside on the rivet 26.

The center 35 rests freely on the shoulder 34. The snap disc 28 also rests freely, i.e. without mechanical stress, on an inner bottom 37 of the lower part 14 by way of its edge 36.

According to FIG. 1, the inner surface 37 is designed as a wedge-shaped support shoulder 38 which ascends radially outwardly and serves as a support surface for the edge 36.

If the temperature of the snap disc 28 then increases, its edge 36 in FIG. 1 is lifted upward such that the snap disc 28 snaps from its convex position shown in FIG. 1 into its concave position shown in FIG. 2 in which its edge 36 is supported against the inside of the switch 10, in this case against the spring disc 27, as can be seen in FIG. 2.

When transitioning from its low-temperature configuration in FIG. 1 into its high-temperature configuration in FIG. 2, the snap disc 28 is therefore supported by way of its edge 36 against the spring disc 27, pressing by way of its center 35 onto the shoulder 34 of the rivet 26 and, as a result, pressing the current transfer member 24 away from the stationary counter contacts 19 and 21 against the force of the spring disc 27.

As a result of said movement, the rivet 26 is settled on the inner bottom 37 of the lower part 14, while at the same time the spring disc 27 snaps from its first configuration shown in FIG. 1 to its likewise stable second geometric configuration shown in FIG. 2.

While the spring disc 27 holds the current transfer member 24 in abutment with the counter contacts 19 and 21 in its first configuration according to FIG. 1 when switch 10 is closed, it holds the current transfer member 24 at a distance from the counter contacts 19 and 21 in its second configuration according to FIG. 2 when switch 10 is open.

While switch 10 is shown in FIG. 1 in its closed state, it is situated in FIG. 2 in its open state.

If the temperature of the device to be protected and consequently the temperature of the switch 10 cools down again then, the snap disc 28 snaps from its high-temperature configuration according to FIG. 2 back again into its low-temperature configuration, which it had already assumed in FIG. 1.

The snap disc 28 is again in its low-temperature configuration to which it has cooled down as a result of the cooling of the device to be protected. The edge 36 of the snap disc 28 will move downwards, so that it comes to rest on the support shoulder 38 provided at switch 10 in FIG. 1.

The snap disc 28 will therefore push the spring disc 27 back into its first configuration when transitioning into its low-temperature configuration.

In the embodiment in FIG. 2, however, a circumferential clearance 40 is provided below the edge 36 of the snap disc 28, which is provided in an edge area 41 of the inner base 37.

When the snap disc 28 of switch 10 is again in its low-temperature configuration according to FIG. 2, it has moved with its edge 36 into the clearance 40. The snap disc 28 of the switch 10 according to FIG. 2 is therefore not able to push up the spring disc 27 at its center 32.

The switch 10 of FIG. 2 therefore remains open even if the snap disc 28 has moved back to its low-temperature configuration. However, vibrations may cause the switch 10 of FIG. 2 to close again, which is undesirable with one-time switches.

A closing lock 39 is provided, which is arranged in the area indicated by circles I and II in FIGS. 1 and 2. For the sake of clarity, embodiments of the locking devices 39 are not shown in FIGS. 1 and 2 but in FIGS. 3 to 8.

The task of the closing locks 39 is to mechanically lock the temperature-dependent switching mechanism 12 permanently in a switch 10 that it has been opened once, so that the switch 10 cannot close again even if the snap disc 28 cools down again.

While at the switch 10 of FIG. 1 the closing locks 39 must permanently absorb the closing pressure exerted by the cooled down snap disc 28, this closing pressure is missing at switch 10 of FIG. 2, because the edge 36 of the snap disc 28 does not find a support shoulder 38 here, but is located in the clearance 40.

Figure 3:
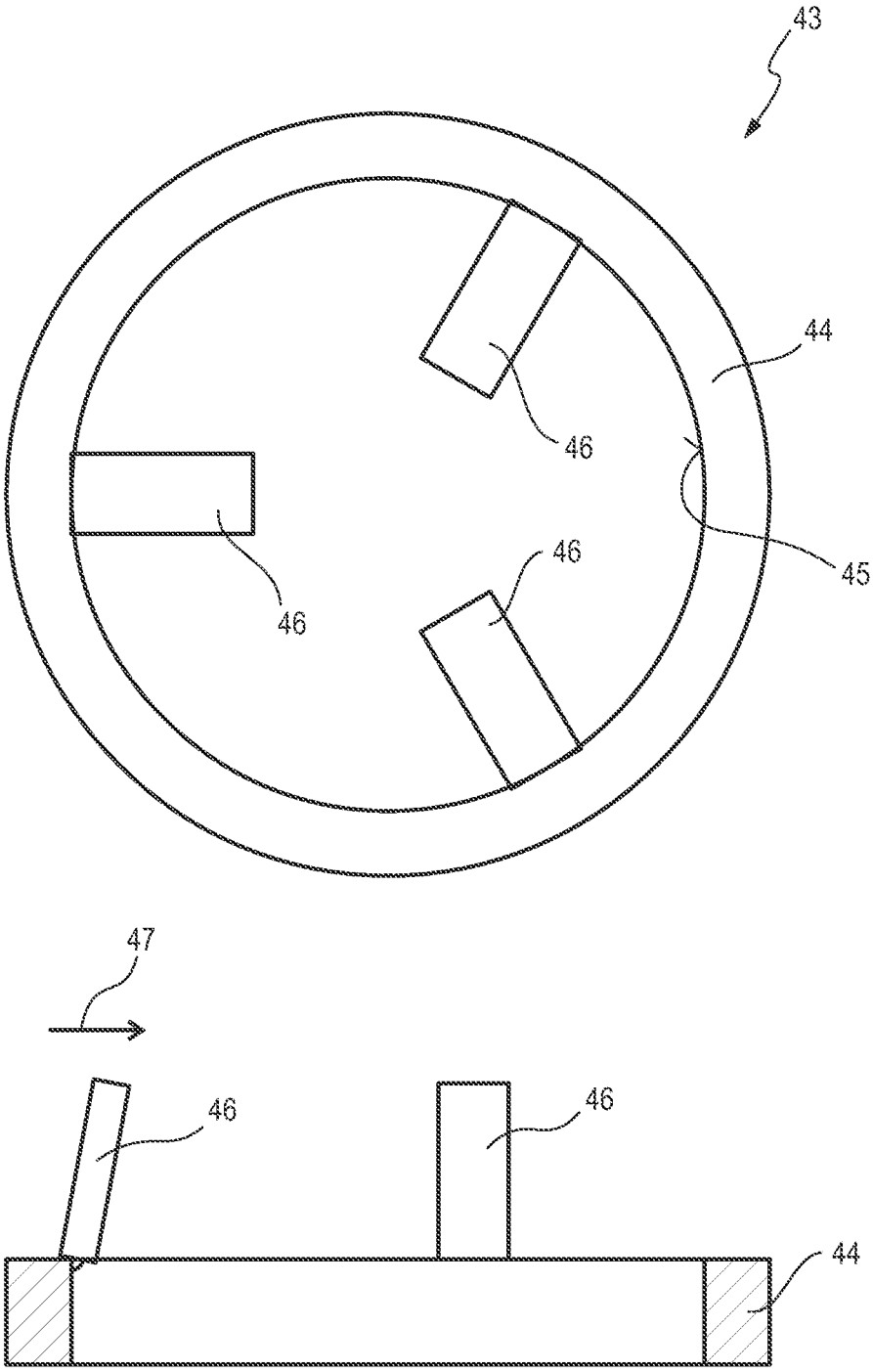
FIG. 3 shows a first embodiment of a spring washer used as a closing lock, wherein the top part shows a top view with tongues lying in the ring plane, and the bottom part shows a sectional view with tongues that are bent upwards and inwardly resilient.
Figure 4:
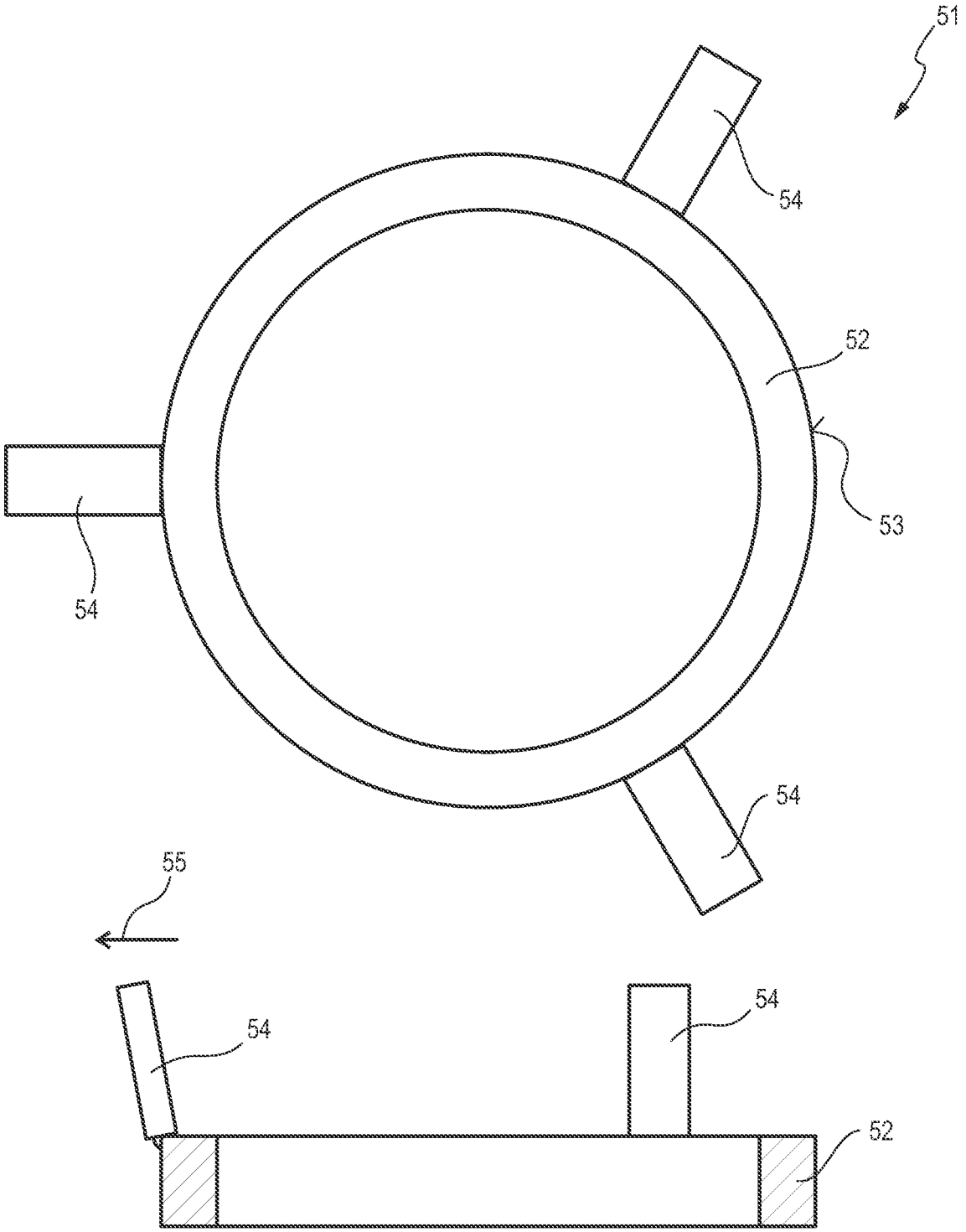
FIG. 4 shows a second embodiment of a spring washer used as a closing lock, wherein the top part shows a top view with tongues lying in the ring plane, and the bottom part shows a sectional view with tongues that are bent upwards and inwardly resilient.

The closing locks 39 each comprise a spring washer 43, 51, as shown schematically and not to scale in FIG. 3 in a first embodiment and in FIG. 4 in a second embodiment.

The spring washer 43 is shown in a top view in the upper part of FIG. 3. It comprises an annular surface 44, with the inside 45 of which three resilient tongues 46 are integrally formed. The spring washer 43 is punched out of spring steel and is initially provided as shown in the upper part of FIG. 3, namely with tongues 46 lying in the ring plane.

The tongues 46 are then bent upwards by approx. 85°, as shown in the sectional side view in the lower part of FIG. 3. If the tongues 46 are now bent further outwards during assembly, they spring radially inwards in the direction of the arrow 47.

The spring washer 51 is shown in a top view in the upper part of FIG. 4. It comprises an annular surface 52, with the outside 53 of which three resilient tongues 54 are integrally formed. The spring washer 51 is punched out of spring steel and is initially provided as shown in the upper part of FIG. 4, namely with tongues 54 lying in the ring plane.

The tongues 54 are then bent upwards by approx. 85°, as shown in the sectional side view in the lower part of FIG. 4. If the tongues 54 are now bent further inwards during assembly, they spring radially outwards in the direction of the arrow 55.

Figure 5:
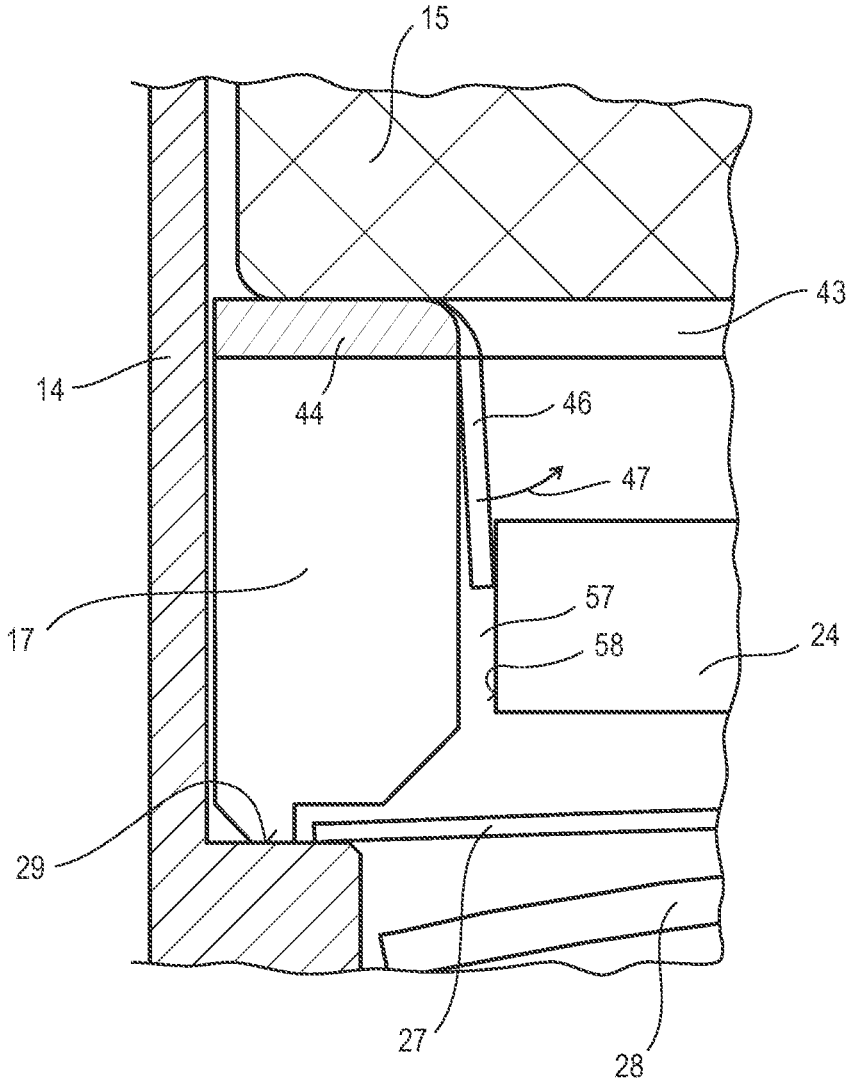
FIG. 5 shows an enlarged view of section I of FIG. 1, but with the spring washer according to FIG. 3.

FIG. 5 shows an enlarged view of the detail I of the closed switch 10, which detail is marked in FIG. 1. The spring washer 43 from FIG. 3 rests with its annular surface 44 on top of the spacer ring 17 and is clamped between the spacer ring 17 and the upper part 15 and thus fixed. The tongues 46 are located in a gap 57 between the spacer ring 17 and a radially outwardly directed edge 58 of the current transfer member 24.

The tongues 46 were bent radially outwards during assembly and extend at almost 90° to the annular surface 44, so that they are spring preloaded radially inwards and lie against the edge 58, as indicated by the arrow 47.

For this assembly, if necessary, an expanding tool is used with which the tongues 46 are pressed into the lower part 14 and radially outwards onto the spacer ring 17, but without bending them, while inserting the spring washer 43.

Figure 6:
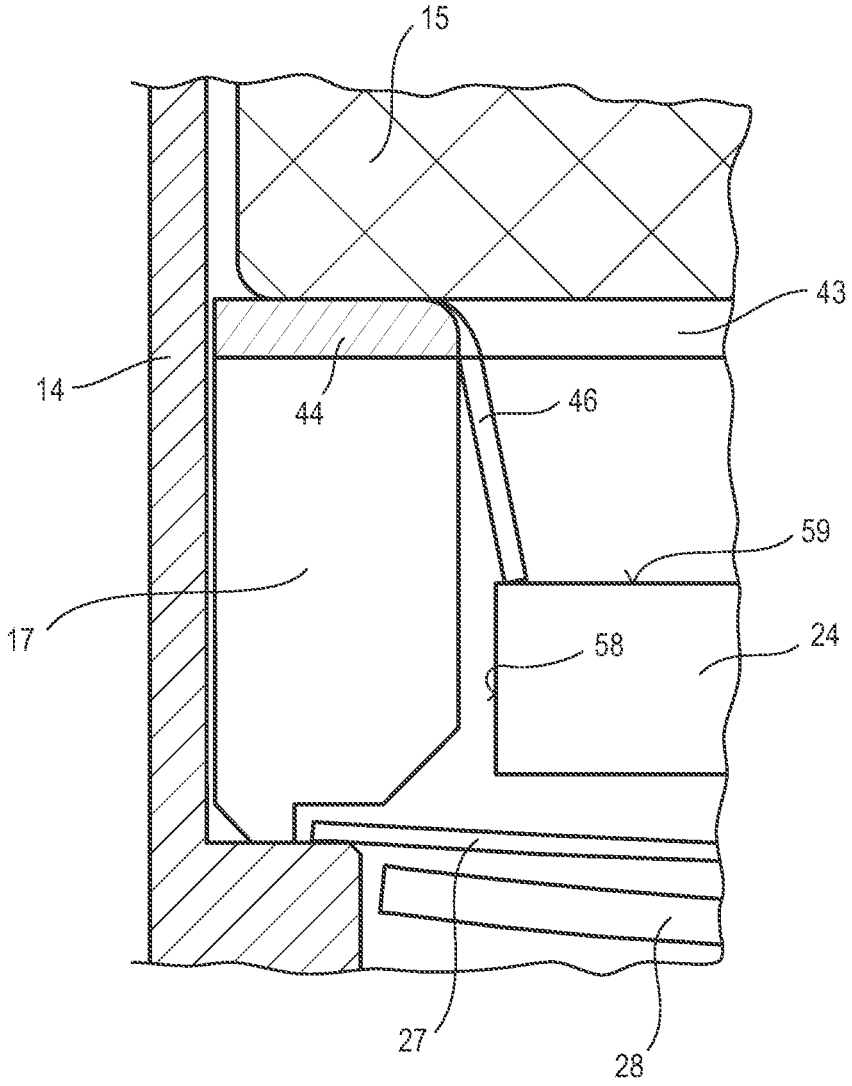
FIG. 6 shows a representation as in FIG. 5, but with the switch open.

If the switch 10 is now opened, the current transfer member moves downwards in FIG. 5 and assumes the position shown in FIG. 6. FIG. 6 shows an enlarged view of the detail of the opened switch 10 which is indicated by I in FIG. 2.

During this movement of the current transfer member 24, the tongues 46 are released from its edge 58, move radially inwards and thus pass over the current transfer member 24, which they mechanically lock by contact with its upper side 59 in a permanent manner. In the area where the tongues 46 rest on the upper side 59, the upper side 59 is preferably not electrically conductive.

The current transfer member 24 is thus prevented from moving upwards again into abutment with the two counter contacts 19, 21, even if the switching mechanism 12 cools down again and the spring disc 27 is snapped back to its first configuration.

Figure 7:
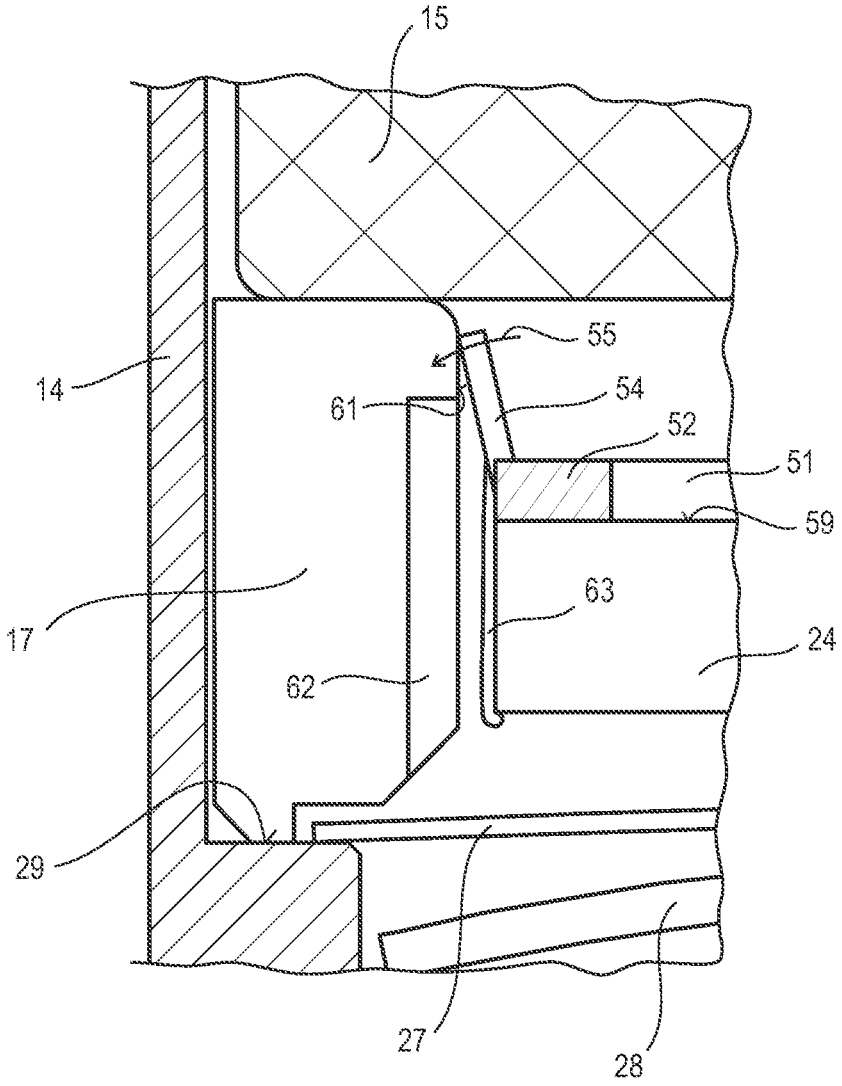
FIG. 7 shows an enlarged view of section I of FIG. 1, but with the spring washer according to FIG. 4.

FIG. 7 shows an enlarged view of the detail I of the closed switch 10, which detail is marked in FIG. 1. The spring washer 51 from FIG. 4 rests with its annular surface 52 on the upper side 59 of the current transfer member 24 and is suitably fixed there, for example by gluing or soldering. In the area where the spring washer 51 rests on the upper side 59, the upper side 59 is preferably not electrically conductive.

The tongues 54 rest against a radially inwardly facing inner surface 61 of the spacer ring 17. The tongues 54 have been bent radially inwards during assembly by contact with the spacer ring 24 and extend at almost 90° to the annular surface 52, so that they lie against the inner face 61 in a radially outward, spring preloaded manner.

The assembly is carried out in such a way that first the switching mechanism 12 is inserted into the lower part 14 and then the spacer ring 17. Then the spring washer is inserted into the spacer ring 17 until it rests on the upper side 59 of the current transfer member 24. Then the spring washer 51 is fixed to the upper side 59.

Figure 8:
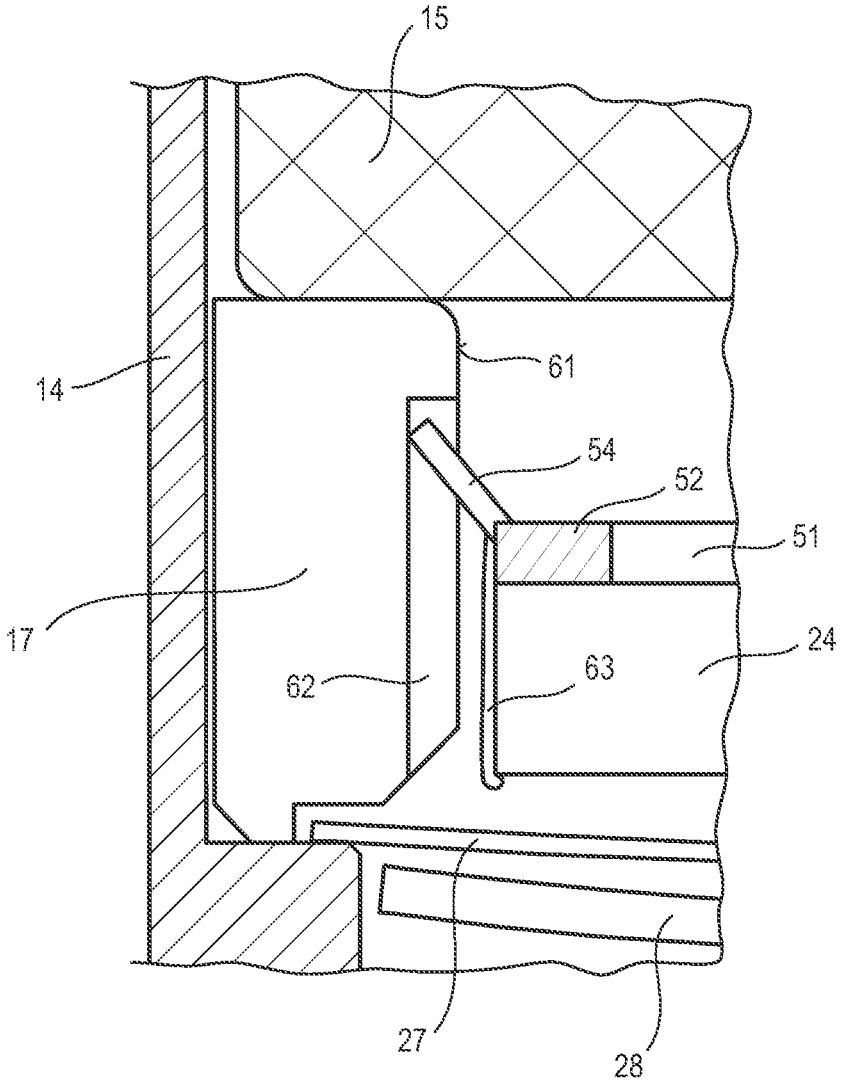
FIG. 8 shows a representation as in FIG. 5, but with the switch open.

If the switch 10 is now opened, the current transfer member moves together with the spring washer 51 downwards in FIG. 7 and assumes the position shown in FIG. 8. FIG. 8 shows an enlarged view of the detail of the closed switch 10 which is indicated by I in FIG. 2.

During this movement of the current transfer member 24, the tongues 54 are released from the inner surface 61, move radially outwards and enter the recess 62 in the spacer ring 17, which is located below the inner surface 61 and is set back radially outwards.

In this way, the current transfer member 24 is mechanically locked in a permanent manner by the contact of the tongues 54 in the recess 62. The current transfer member 24 is thus prevented from moving upwards again into abutment with the two counter contacts 19, 21, even if the switching mechanism 12 cools down again and the spring disc 27 is snapped back to its first configuration.

The spring washer 51 can also be attached to the current transfer member 24 by means of clamps 63, which are arranged on the spring washer 51 and embrace the current transfer member 24. This type of fixing is done when inserting the spring washer 51 and saves subsequent fixing by gluing or soldering.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A temperature-dependent switch, comprising: a first stationary counter contact, a second stationary counter contact, and a temperature-dependent switching mechanism having a current transfer member, wherein the switching mechanism is configured to close and open the switch depending on its temperature, wherein the switching mechanism is configured to close the switch by pressing the current transfer member against the first counter contact and the second counter contact and thereby establishing an electrically conductive connection between the first counter contact and the second counter contact via the current transfer member, and to open the switch by keeping the current transfer member at a distance from the first counter contact and the second counter contact and thereby interrupting the electrically conductive connection, wherein the switch further comprises a closing lock which is configured to keep the switch open when it has been opened for the first time, wherein the closing lock comprises a spring washer with at least one resilient tongue which is configured to directly interact with at least one of the current transfer member or a spacer ring in order to mechanically lock the current transfer member in a permanent manner when the switch has been opened for the first time, so that the switch remains permanently open.

2. The switch according to claim 1, wherein the temperature-dependent switching mechanism comprises a temperature-dependent snap disc having a geometrical high-temperature configuration and a geometrical low-temperature configuration, and a bistable spring disc at which the current transfer member is arranged, wherein the spring disc has two geometrical configurations which are stable in a temperature-independent manner, wherein, in a first configuration of said two geometrical configurations, the spring disc is configured to press the current transfer member against the first counter contact and the second counter contact and, wherein, in a second configuration of said two geometrical configurations, the spring disc is configured to keep the current transfer member away from the first counter contact and the second counter contact.

3. The switch according to claim 2, wherein the snap disc is configured to exert a force on the spring disc such that the spring disc snaps from the first configuration to the second configuration, when the snap disc transitions from the geometrical low-temperature configuration to the geometrical high-temperature configuration.

4. The switch according to claim 3, wherein the snap disc is fixed to the current transfer member, wherein a clearance is provided in an area around an edge of the snap disc, and wherein the edge of the snap disc is configured to project at least partially into said clearance when the snap disc reassumes its geometrical low-temperature configuration with the spring disc being in its second configuration.

5. The switch according to claim 2, wherein the snap disc and the spring disc are fixed to the current transfer member.

6. The switch according to claim 1, further comprising a housing, wherein the first counter contact and the second counter contact are arranged at the housing, and wherein the switching mechanism is arranged in the housing.

7. The switch according to claim 6, wherein the housing comprises a lower part and an upper part for closing the lower part, wherein the first counter contact and the second counter contact are arranged on an inner side of the upper part.

8. The switch according to claim 2, further comprising a housing that comprises a lower part and an upper part for closing the lower part, wherein the first counter contact and the second counter contact are arranged on an inner side of the upper part, and wherein a clearance is provided between the snap disc and the lower part, such that the snap disc does not contact the lower part in its geometrical high-temperature configuration and in its geometrical low-temperature configuration.

9. The switch according to claim 2, wherein the snap disc is a bi- or trimetal snap disc.

10. The switch according to claim 7, wherein the spring washer is configured to interact with the current transfer member and with a spacer ring which is arranged between the upper part and the lower part.

11. The switch according to claim 10, wherein the spring washer is arranged on the current transfer member and comprises at least one locking member, which is configured to interact with the spacer ring.

12. The switch according to claim 11, wherein the locking member comprises a radially outwardly resilient tongue, which rests pre-stressed against an inner surface of the spacer ring when the switch is closed, and which braces on a recess in the spacer ring when the switch is open.

13. A temperature-dependent switch, comprising: a first stationary counter contact, a second stationary counter contact, and a temperature-dependent switching mechanism having a current transfer member, wherein the switching mechanism is configured to close and open the switch depending on its temperature, wherein the switching mechanism is configured to close the switch by pressing the current transfer member against the first counter contact and the second counter contact and thereby establishing an electrically conductive connection between the first counter contact and the second counter contact via the current transfer member, and to open the switch by keeping the current transfer member at a distance from the first counter contact and the second counter contact and thereby interrupting the electrically conductive connection, wherein the switch further comprises a closing lock which is configured to keep the switch open when it has been opened for the first time, wherein the closing lock comprises a spring washer which is configured to directly interact with the current transfer member and to mechanically lock the current transfer member in a permanent manner when the switch has been opened for the first time, so that the switch remains permanently open, wherein the switch further comprises a housing, wherein the first counter contact and the second counter contact are arranged at the housing, and wherein the switching mechanism is arranged in the housing, wherein the housing comprises a lower part and an upper part for closing the lower part, wherein the first counter contact and the second counter contact are arranged on an inner side of the upper part, wherein the spring washer is configured to interact with the current transfer member and with a spacer ring which is arranged between the upper part and the lower part, and wherein the spring washer is arranged between the spacer ring and the upper part, and wherein the spring washer comprises at least one locking member, which is configured to interact with the current transfer member.

14. The switch according to claim 11, wherein the locking member comprises a radially inwardly resilient tongue, which rests pre-stressed against an edge of the current transfer member when the switch is closed, and which braces on the current transfer member when the switch is open.

15. A temperature-dependent switch, comprising: a first stationary counter contact, a second stationary counter contact, and a temperature-dependent switching mechanism having a current transfer member, wherein the switching mechanism is configured to close and open the switch depending on its temperature, wherein the switching mechanism is configured to close the switch by pressing the current transfer member against the first counter contact and the second counter contact and thereby establishing an electrically conductive connection between the first counter contact and the second counter contact via the current transfer member, and to open the switch by keeping the current transfer member at a distance from the first counter contact and the second counter contact and thereby interrupting the electrically conductive connection, wherein the switch further comprises a closing lock which is configured to keep the switch open when it has been opened for the first time, wherein the closing lock comprises a spring washer which is configured to directly interact with the current transfer member to mechanically lock the current transfer member in a permanent manner when the switch has been opened for the first time, so that the switch remains permanently open, and wherein the temperature-dependent switching mechanism comprises a temperature-dependent snap disc having a geometrical high-temperature configuration and a geometrical low-temperature configuration, and a bistable spring disc at which the current transfer member is arranged, wherein the spring disc is spaced apart from the spring washer and has two geometrical configurations which are stable in a temperature-independent manner, wherein, in a first configuration of said two geometrical configurations, the spring disc is configured to press the current transfer member against the first counter contact and the second counter contact and, wherein, in a second configuration of said two geometrical configurations, the spring disc is configured to keep the current transfer member away from the first counter contact and the second counter contact.

* * * * *